US006511581B1

(12) United States Patent
Nissinen

(10) Patent No.: US 6,511,581 B1
(45) Date of Patent: Jan. 28, 2003

(54) METHOD FOR CONTROLLING MIST AND DUST IN THE MANUFACTURE AND FINISHING OF PAPER AND BOARD BY AN ION BLAST WIND

(75) Inventor: Vilho Nissinen, Numminen (FI)

(73) Assignee: Valmet Corporation, Helsinki (FI)

( * ) Notice: Subject to any disclaimer, the term of this patent is extended or adjusted under 35 U.S.C. 154(b) by 0 days.

(21) Appl. No.: 09/508,943

(22) PCT Filed: Sep. 23, 1998

(86) PCT No.: PCT/FI98/00748

§ 371 (c)(1),
(2), (4) Date: Mar. 17, 2000

(87) PCT Pub. No.: WO99/15731

PCT Pub. Date: Apr. 1, 1999

(30) Foreign Application Priority Data

Sep. 24, 1997 (FI) ..... 973776

(51) Int. Cl.[7] ..... D21F 1/32
(52) U.S. Cl. ..... 162/199; 162/272
(58) Field of Search ..... 134/1, 15; 162/199, 162/272; 96/97; 15/1.51

(56) References Cited

U.S. PATENT DOCUMENTS

| | | | | | |
|---|---|---|---|---|---|
| 2,740,184 | A | * | 4/1956 | Thomas | 131/110 |
| 2,920,987 | A | * | 1/1960 | Landry et al. | |
| 3,395,042 | A | * | 7/1968 | Herbert | |
| 3,523,319 | A | * | 8/1970 | Stoever | |
| 3,536,528 | A | * | 10/1970 | Geest | |
| 3,670,203 | A | * | 6/1972 | Whitmore et al. | 361/214 |
| 3,781,105 | A | * | 12/1973 | Meagher | |
| 3,879,785 | A | * | 4/1975 | Roth et al. | |
| 3,943,049 | A | | 3/1976 | Zucker | |
| 3,959,690 | A | * | 5/1976 | Leibrecht | |
| 4,405,342 | A | | 9/1983 | Bergman | |
| 4,454,621 | A | * | 6/1984 | Testone | |
| 4,677,704 | A | * | 7/1987 | Huggins | |
| 4,727,614 | A | * | 3/1988 | Swistun | |
| 4,835,808 | A | | 6/1989 | Hahne et al. | 15/1.5 R |
| 4,941,224 | A | | 7/1990 | Saeki et al. | |
| 4,955,991 | A | | 9/1990 | Torok et al. | |
| 5,100,440 | A | | 3/1992 | Stahel et al. | |
| 5,110,324 | A | | 5/1992 | Testone et al. | |
| 5,180,404 | A | * | 1/1993 | Loreth et al. | 55/117 |
| 5,211,760 | A | * | 5/1993 | Kedarnath | 134/1 |
| 5,257,079 | A | * | 10/1993 | Lange et al. | 355/303 |
| 5,421,901 | A | * | 6/1995 | Whitney et al. | 134/15 |
| 5,585,426 | A | * | 12/1996 | Williams et al. | 524/366 |
| 6,287,368 | B1 | | 9/2001 | Ilmasti | |

FOREIGN PATENT DOCUMENTS

| | | | |
|---|---|---|---|
| DE | 32 29 383 A1 | 2/1984 | B65B/55/24 |
| DE | 41 20 973 A1 | 1/1993 | B08B/5/04 |
| EP | 0 524 415 A2 | 1/1993 | B08B/5/04 |
| EP | 0 682 992 A2 | 11/1995 | B08B/5/02 |
| WO | WO 98/11999 | 3/1998 | B05D/1/04 |

* cited by examiner

*Primary Examiner*—Steven P. Griffin
*Assistant Examiner*—Carlos Lopez
(74) *Attorney, Agent, or Firm*—Cohen, Pontani, Lieberman & Pavane

(57) ABSTRACT

A method for controlling particulate matter occurring in the manufacture of paper and board. A web (1) is passed to web treatment equipment (22, 23) wherein at least one treatment step is applied to the web (1) causing the emission of particulate matter (24). In the vicinity of the emission point (21) of the particulate matter are placed at least two electrodes (25, 26) and at least one electrode, called a counter-electrode (26), is at a low potential. At least one electrode (25) is at a potential higher than that of the counter-electrode (26), and the potential difference between the electrodes (25, 26) is made to generate a corona discharge between the electrodes that causes an ion-blast wind toward the electrode (26) of the lower potential, the ion-blast wind transferring particulate matter, which enters the gap between the electrodes, toward the electrode of lower potential.

8 Claims, 1 Drawing Sheet

METHOD FOR CONTROLLING MIST AND DUST IN THE MANUFACTURE AND FINISHING OF PAPER AND BOARD BY AN ION BLAST WIND

PRIORITY CLAIM

This is a U.S. national stage of application No. PCT/FI98/00748, filed on Sep. 23, 1998. Priority is claimed on that application and on application Ser. No. 973776, filed in Finland on Sep. 24, 1997.

FIELD OF THE INVENTION

The present invention relates to a method and apparatus for collecting water vapor, escaped fibrous matter, coat mist and dry fibrous dust occurring in the manufacture of paper and board or adhering the same to the web being processed.

BACKGROUND OF THE INVENTION

The manufacture of paper and board can be divided into two phases comprising the formation of the base web, that is, the base board or paper, followed by the treatment of this web by coating, calendering, slitting and rolling. With the exception of rolling, all of these steps involve emission of different kinds of mist and dust that are detrimental if allowed to escape to the surroundings. Hence, a major portion of the paper machine and finishing equipment must be enclosed in hoods and enclosures. From the interior of such enclosed spaces, the mists are removed by suction with a vacuum. The air sucked off from the enclosed spaces is cleaned from moisture, dust and mist prior to discharging the air into the ambient atmosphere. Such enclosures as well as the cleaning of the sucked air are expensive to implement. The collection systems must be designed for large volumetric air flows, because the internal surfaces of the hoods and equipment must be kept free from condensation or dirt that could fall or otherwise land on the web being manufactured. Particularly in coating a paper web, water droplets or other foreign matter falling on the web can easily cause defects in the web being made. However, regions of insufficient flow velocity may remain in the hood structures that thus may allow accumulation of foreign matter in the system. Furthermore, the collection of coating mist in particular from the exhaust air is cumbersome and complex to arrange, because the collected waste coat cannot be dumped in the plant sewer system due to economical and environmental reasons, but rather, it is recirculated back to the machine circulation. However, as the coat returned to the machine circulation must be free from foreign matter and air bubbles, the collection of coat mist from an air flow is a technically challenging task.

SUMMARY OF THE INVENTION

It is an object of the present invention to provide a method suited for controlling the emissions of dusts, mists and other matter occurring in droplet or particle form in paper manufacture by virtue of guiding such matter to desired surfaces.

The goal of the invention is achieved by way of guiding the droplets or particles to be treated to impinge on a desired surface by means of both an electric field imposed between a counter-electrode taken to a low potential, advantageously to the ground potential, and a plurality of electrodes, advantageously having a pointed structures which are taken to an elevated potential, and additionally by the ion-blast wind induced by a corona discharge generated in the vicinity of the electrodes taken to the elevated potential. Such a collecting surface may be formed by, e.g., the web being made or, alternatively, a purpose-made ground-potential electrode.

The invention offers significant benefits.

By virtue of the invention, air-borne foreign matter can be collected directly to a desired surface which may be a web being treated or formed, for instance. In the case that the coat dust, or alternatively, the humid and fiber-containing mist emitted from the web being formed can be effectively returned to the web running in the process, the amount of foreign material to be removed by means of a vacuum will be reduced substantially and the cleaning of the exhaust air becomes easier. The mist emitted from the coating equipment can be collected directly to a counter-electrode (ground electrode), whereby the collection and removal of coating mist takes place in a single step. Since the mist adheres under electric forces to the collecting electrode, the coating mix layer thus formed contains less air than waste coating collected by conventional techniques from an air flow making the collected coat easier to return to the machine circulation. The design of the assembly is readily modifiable which is a great benefit as the installation space available in paper machines is extremely limited due to different reasons. By virtue of the assembly according to the invention, the emissions to be collected can be captured very close to their point of origin that helps to prevent the soiling of the paper-making equipment. A particularly advantageous benefit is the possibility of returning the collected material back to the web, whereby the amount of recirculating material is reduced.

Other objects and features of the present invention will become apparent from the following detailed description considered in conjunction with the accompanying drawings. It is to be understood, however, that the drawings are intended solely for purposes of illustration and not as a definition of the limits of the invention, for which reference should be made to the appended claims.

BRIEF DESCRIPTION OF THE DRAWINGS

In the following, the invention will be examined in greater detail by making reference to the appended drawings, in which.

DETAILED DESCRIPTION OF THE PRESENTLY PREFERRED EMBODIMENTS

The function of the present invention is based on an application of the so-called ion-blast technique. In this method, a strong electric field is established between one or generally a number of pointed discharge electrodes and a planar counter-electrode. The tip of the pointed electrode supports a corona discharge that charges particles in the vicinity of the electrode and causes formation of ions in the electronegative gas. The ions migrate along the flux lines of the electric field formed between the discharge electrode and the ground-potential counter-electrode, whereby the ions adhere to particles on which they impinge on their travel. The electric field transports particles thus charged to the ground-potential electrode on which they adhere by electric and mechanical forces. If the spacing between the electrodes is made long and the voltage sufficiently high (greater than 50 kV), a gas flow will be created capable of mechanically transferring toward the ground-potential electrode the particles which are passing between the electrodes. This phenomenon is called the ion-blast wind. In the ion-blast effect, the electric field formed from the tip of a pointed electrode will create at the electrode tip a conical field in which the ionized gas and particles are transported. The ion-blast effect will affect both solid particles and liquid droplets.

In paper-making, the ion-blast effect can be utilized for binding a raw material to a web formation substrate or a collecting platform from which the collected material can be removed using a suitable technique. In practice, the collecting substrate may be formed by any surface which is transparent to the electric field or, alternatively, is a conductive surface. As the web in a continuous process is formed on a moving surface, the formation substrate is generally a wire, felt or band. When the method is employed for collecting material at a coating station, for instance, a counter-electrode may be used as the collecting substrate.

Figure 1:
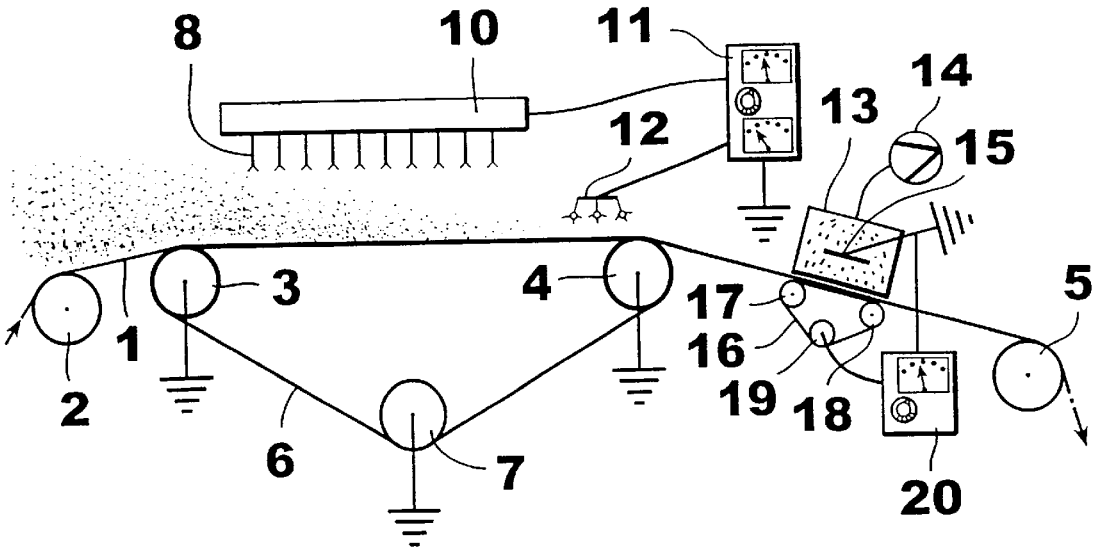
FIG. 1 shows schematically an embodiment of the invention.

In FIG. 1 are shown different applications of the invention. The first embodiment illustrated in the diagram is particularly suited for adhering dust or coat mist to a web. Herein, a web 1 travels supported by four guide rolls 2–5. The first guide roll 2 and the last guide roll 5 only serve to support the incoming and outgoing web 1, respectively. Over guide rolls 3, 4, which are adapted between the outer guide rolls 2, 5, is passed a conductive wire 6 which is arranged to travel along a closed triangular path so as to run over said web-supporting rolls 3, 4 and a wire guide roll 7 which is mounted at a distance from the web 1 itself. The rolls 3, 4, 7 guiding the conductive wire 6 are taken to the ground potential thus allowing said conductive wire 6 to provide a ground-potential surface under the web 1 running on said wire. On the opposite side of the web 1 relative to the conductive wire 6, there are arranged pointed electrode tips 8 which are taken to an elevated potential and are mounted on an electrode support frame 10. The electrode support frame 10 is connected to a high-voltage supply 11. Next to the electrode tips 8 on the machine-direction travel of the web 1 is mounted a post-corona device 11 that is also connected to the high-voltage supply 12.

Further next on the travel of the web 1 is adapted a post-collector unit 13 serving to remove from the web 1 the dust just transferred to said web. The post-collector unit 13 comprises an enclosure housing a counter-electrode 15, whereby said enclosure is taken by means of a fan 14 to a vacuum and has its open side adapted to face the web 1. As the function of the post-collector unit 13 is to remove the dust adhering to the web 1, the counter-electrode 15 in the enclosure above the web is now taken to a low-voltage or ground potential. To the opposite side of the web 1 there is placed a conductive wire 16 running over a triangular path on guide rolls 17, 18, 19. With the help of a high-voltage supply 20, this conductive wire 16 is now taken to a higher potential than the counter-electrode 15 in the post-collector device enclosure. Obviously, the running wire 16 can be replaced by an endless belt or a band.

The field effect of the electrode tips 8 must extend over the desired area of collection. Since the electric field shed from each of the electrode tips 8 has a conical shape, the number and placement of the electrode tips must be arranged so that a uniform field is formed on the counter-electrode 6 by the resultant field of the conical component fields shed from the arrayed tips of discharge electrode tips 8. The required voltage depends on the distance of the counter-electrode 6 from the discharge electrode tips 8 that may vary from 2 mm to 2 m, while in practice a distance of 100 mm to 1000 mm must be used due to the space required by dust collection/transfer equipment. While a greater distance between the electrodes as such has no effect on the function of the apparatus, it will increase the size of the apparatus. The voltage applied between the electrodes may be varied in the range of 30–1000 kV, however, typically a voltage range of 80–160 kV has been found practical for the above-mentioned electrode arrangement. The counter-electrode may be taken to a positive or negative potential and, respectively, also the electrode tips can be connected to the positive or negative polarity of the voltage supply.

In the collection of dry dust, the above-described apparatus functions as follows. Web 1 is passed to the guide roll 2 from, e.g., a edge-trim slitter which during the trimming step releases dust from the edge of the web that subsequently begins to travel along with the moving web 1 due to the boundary air layer carried by the web. When the web 1 comes under the discharge electrode tips 8, the ion-blast stream emitted from the electrode tips 8 carries the dust particles toward the conductive wire 6 which supports the travel of the web 1. The dust particles will adhere to the web 1 under electric and mechanical forces. Consequently the dust particles will continue to travel on the web 1, thence being prevented from being scattered about. As a permanent adhesion of the dry dust to the web is not generally desirable, the dust is subsequently removed from the web. The dust-removal step is carried out be means of a post-collector device 13. In this apparatus, the electrode potentials are reversed in regard to those used in the above-described dust-adhering apparatus, whereby also the charge of the dust particles is reversed allowing them to leave the web 1. Next, the released dust migrates toward the counter-electrode 15 of the post-collector device 13 and further away from the post-collector device along with the suction flow established by the suction fan 14. The collected dust may be recirculated to the web formation process or, for instance, combusted to produce thermal energy.

In addition to the collection of dry dust, the method according to the invention may be employed to bind back to the web 1 either the fiber-containing water mist emitted from the web formation process, or, particularly, the coat mist emitted from the coating equipment, or, particularly, a specifically generated coat aerosol that is applied to the web at least partially by virtue of the ion-blast technique. Such a coat aerosol can be made with the help of spray nozzles, for instance. Herein, the post-collector device 13 will obviously be omitted, because the particles are desiredly adhered to the web in a permanent manner. The ion-blast assembly may under certain conditions act as a capacitor capable of storing a charge, whereby the forces that hold the web against its carrier can act disturbingly after the web has passed the counter-electrode area. In order to neutralize such forces of attraction, a corona treatment operating with positive or negative ions may be employed downstream from the web formation unit. The corona treatment is carried out using a device 12 with a structure similar to that of the ion-blast assembly.

Figure 2:
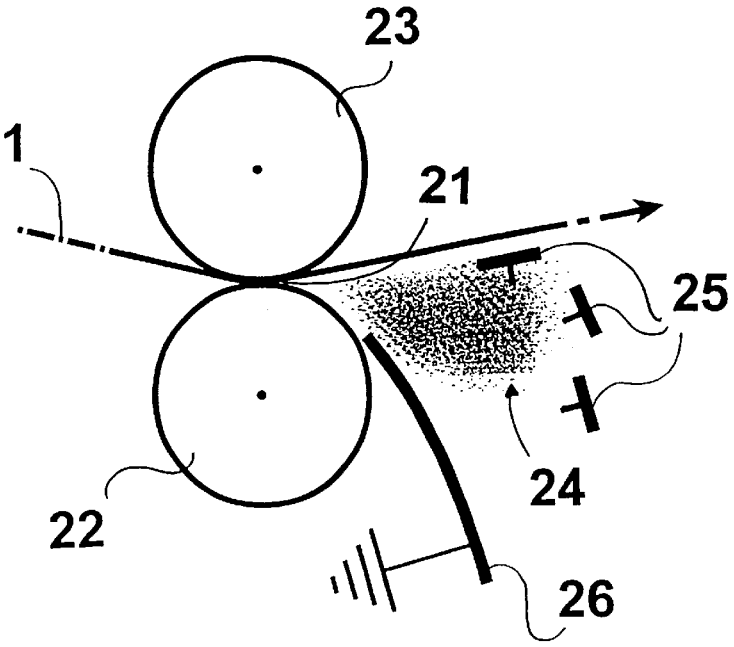
FIG. 2 shows schematically an embodiment of the invention.

In FIG. 2 is shown schematically a collection method for mist emitted from the nip 21 of a transfer-roll coater. As the structure of the transfer-roll coater is irrelevant to the application of the invention, the coater is illustrated only for the nip 21 formed between two rolls 22, 23. The lower roll is a transfer roll 22 from whose surface the metered coat is transferred in the nip 21 to the surface of the web 1 passing through the nip. The function of the backing roll 23 is to maintain a proper distance between the web 1 and the transfer roll 22. Particularly at high web speeds, a great amount of mist 24 will be emitted from the nip of a transfer-roll coater due to the interaction of the web 1 and the applicator roll. The mist is formed when a portion of the coat film carried on the surface of the transfer roll 22 adheres to the web 1 and the other portion continues to adhere to the surface of the transfer roll 22, whereby the coat film undergoes splitting when the web 1 exits from the nip 21 and thereby some amount of coat droplets are ejected from the nip tangentially with the surface of the web 1 and the surface of the transfer roll 22.

According to the invention, the thus emitted mist can be collected with the help of the ion-blast effect on a counter-electrode 26. The electrodes 25 and 26 are mounted, e.g., as shown in FIG. 2 in the the transfer roll 22 and the web 51 so that the pointed electrodes 25 can be used to ionize the mist emitted into the gap between the electrodes, thus transporting the mist to the counter-electrode 22, wherefrom it can be collected for reuse. Accordingly, the electrodes are arranged so that the emitted mist will be enclosed by the electrodes. While the coating mist falls naturally downward along the counter-electrode surface gravitationally, its removal may be augmented by vibration or scraping.

Obviously, the above-described examples and the different embodiments covered by their specifications in the appended claims may be implemented using one or a greater number of power supplies.

Thus, while there have been shown and described and pointed out fundamental novel features of the present invention as applied to a preferred embodiment thereof, it will be understood that various omissions and substitutions and changes in the form and details of the devices illustrated, and in their operation, may be made by those skilled in the art without departing from the spirit of the present invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

What is claimed is:

1. A method for controlling particulate matter generated during the manufacture or processing of a web paper and board comprising:

positioning a first pair of electrodes proximate a location where the particulate matter is generated, one of the first pair of electrodes being positioned proximate a first side of the web and the other of the first pair of electrodes being positioned proximate a second side of the web;

setting a potential difference between the two electrodes of the first pair of electrodes so as to generate a corona discharge between the two electrodes of the first pair of electrodes that causes an ion-blast wind toward one electrode with a lower potential, the ion-blast wind being sufficient to transport particulate matter passing between the two electrodes to travel toward the electrode with the lower potential so as to contact the web;

positioning a second pair of electrodes downstream of the first pair of electrodes in a direction of movement of the web, one of the second pair of electrodes being positioned proximate a first side of the web and the other of the second pair of electrodes being positioned proximate a second side of the web; and setting a potential difference between the two electrodes of the second pair of electrodes so as to generate a corona discharge between the two electrodes of the second pair of electrodes that causes an ion-blast wind toward one electrode with a lower potential, the ion-blast wind being sufficient to cause particulate matter on the web passing between the two electrodes to leave the web to travel toward the electrode with the lower potential.

2. The method of claim 1, wherein one of the electrodes of one of the pairs of electrodes comprises a movable endless electrically conducting support member, one surface of the web resting on the support member, and wherein the other of the one of the pairs of electrodes comprises a plurality of pointed discharge electrodes disposed proximate the other surface of the web.

3. The method of claim 1, wherein the potential difference between the electrodes of each pair of electrodes is between 30 kV and 1000 kV.

4. The method of claim 3, wherein the potential difference is between 80 kV and 160 kV.

5. The method of claim 3, wherein a distance between the electrodes of each pair of electrodes is between 2 mm and 2 m.

6. The method of claim 5, wherein the distance is between 100 mm and 1000 mm.

7. The method of claim 2, wherein one electrode of both of the pairs of electrodes is a movable endless electrically conducting support member upon which one surface of the web is resting.

8. The method of claim 7, wherein the movable endless electrically conducting support member of the first pair of electrodes has a lower potential than the other electrode of the first pair of electrodes, and wherein the movable endless electrically conducting support member of the second pair of electrodes has a higher potential than the other electrode of the second pair of electrodes.

* * * * *